US005139165A

United States Patent [19]

Hara

[11] Patent Number: 5,139,165

[45] Date of Patent: Aug. 18, 1992

[54] CONTAINER FOR PHOTOGRAPHIC FILM CARTRIDGE

[75] Inventor: Yoshio Hara, Kanagawa, Japan

[73] Assignee: Fuji Photo Film Co., Ltd., Minami-Ashigara, Japan

[21] Appl. No.: 705,032

[22] Filed: May 21, 1991

[30] Foreign Application Priority Data

May 22, 1990 [JP] Japan ..... 2-130212
Sep. 27, 1990 [JP] Japan ..... 2-255174

[51] Int. Cl.[5] ..... B65D 43/14

[52] U.S. Cl. ..... 220/339; 220/306; 220/307; 220/337; 220/355; 206/389; 206/316.1

[58] Field of Search ..... 220/339, 306, 355, 307, 220/337; 206/389, 268, 616, 316.1, 407, 408; 229/87.05

[56] References Cited

U.S. PATENT DOCUMENTS

| | | | |
|---|---|---|---|
| 3,379,364 | 4/1968 | Pilger | 229/87.05 |
| 3,651,983 | 3/1972 | Haugen | 220/339 X |
| 4,407,410 | 10/1983 | Graetz et al. | 220/339 X |
| 4,687,100 | 8/1987 | Kreeger | 220/339 X |
| 4,733,794 | 3/1988 | Kent | 220/339 X |
| 4,733,796 | 3/1988 | Halverstadt et al. | 220/339 |
| 4,779,756 | 10/1988 | Buelens et al. | 220/307 |
| 4,801,011 | 1/1989 | Desdoigts et al. | 206/389 |
| 4,826,008 | 5/1989 | Cloosterman | 206/407 X |
| 4,921,737 | 5/1990 | Akao | 206/316.1 X |
| 4,947,994 | 8/1990 | Newsome | 206/616 |

*Primary Examiner*—Stephen Marcus
*Assistant Examiner*—Paul A. Schwarz
*Attorney, Agent, or Firm*—Burns, Doane, Swecker & Mathis

[57] ABSTRACT

A container for a photographic film cartridge consisting essentially of a container body portion being flexible and polygonal and a cap portion fittable to the container body portion revolvably and integrally connected therewith, and the fitting between the container body portion and the cap portion being releasable by deforming the container body portion. When the cartridge is taken out of the container, the cap portion is gradually detached from the container body portion according to the deformation caused by pinching and pressing it. Since the cap portion is connected to the container body portion, the cap portion is still joined to the container body portion, after the fitting is released. Therefore, the container can be opened easily with one hand, and the cap portion is not lost.

6 Claims, 11 Drawing Sheets

FIG. 3
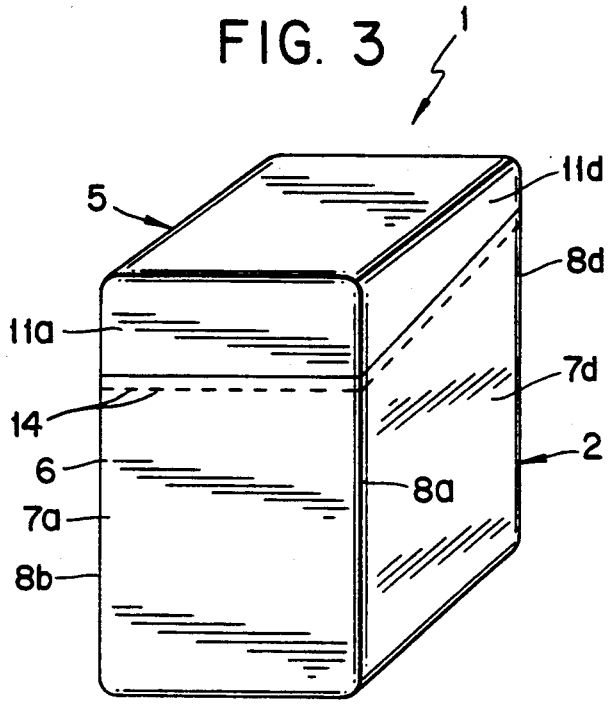
FIG. 5
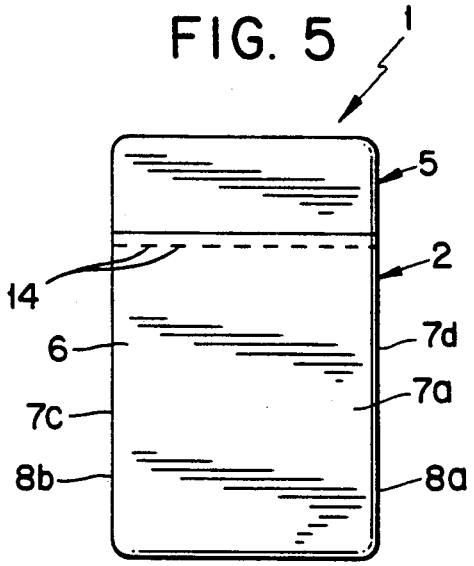
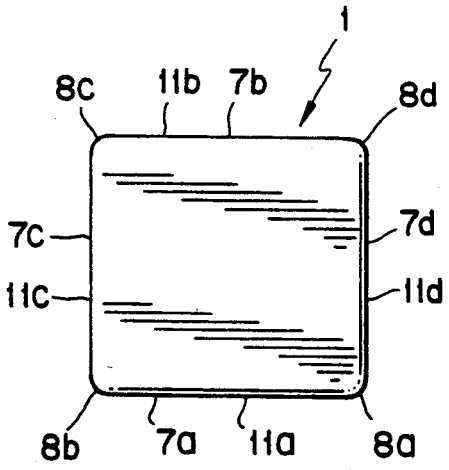
FIG. 4
FIG. 6
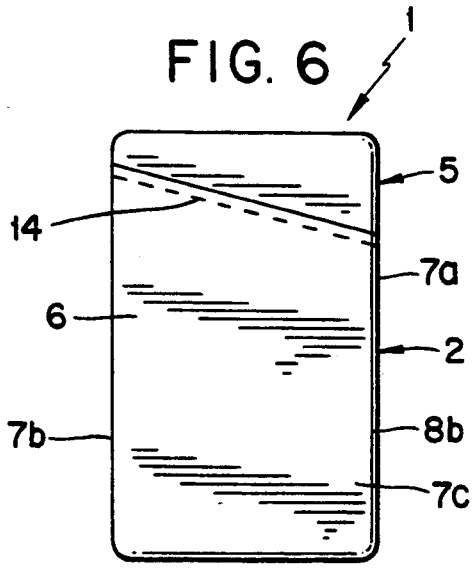

FIG. 7
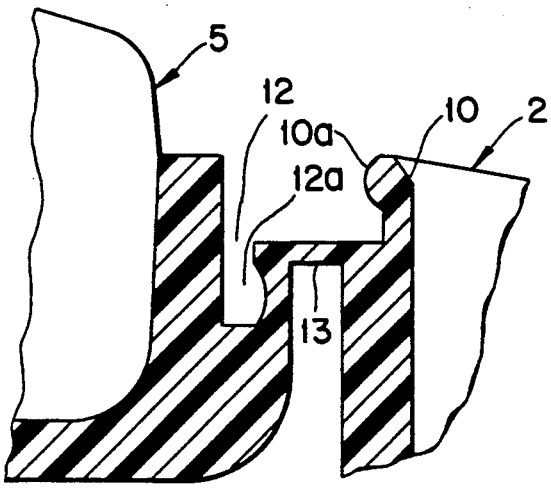
FIG. 8(a)
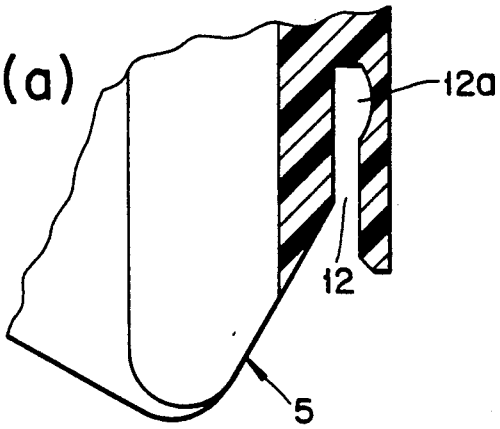
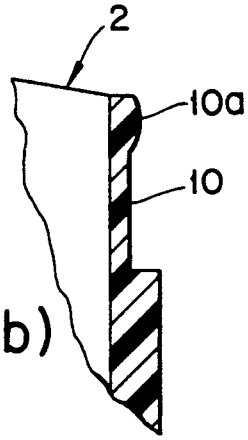
FIG. 8(b)
FIG. 9
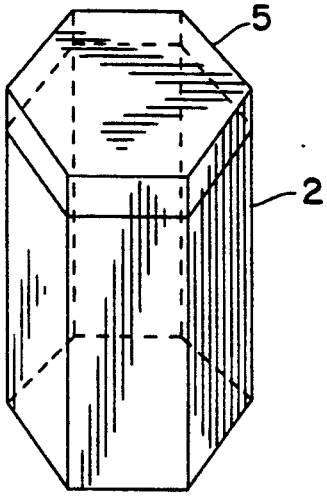
FIG. 10
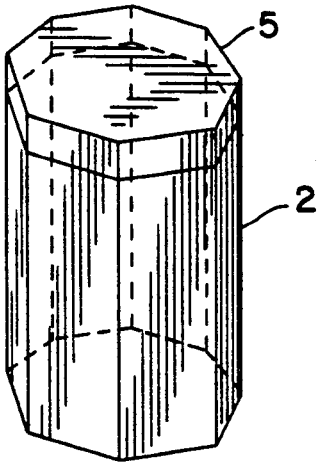

FIG. 11(a)
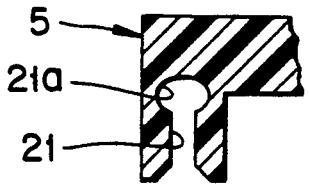
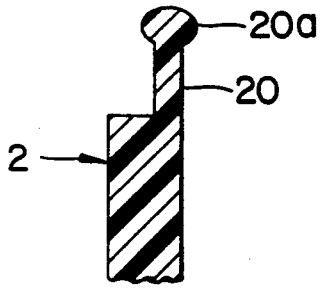
FIG. 11(b)
FIG. 12(a)
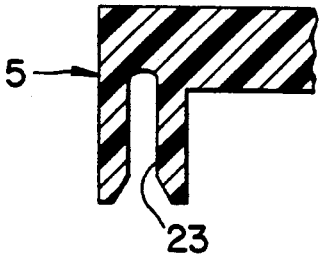
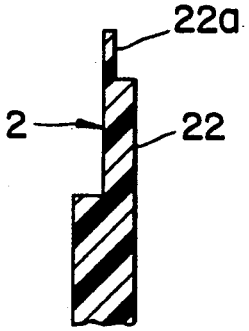
FIG. 12(b)
FIG. 13(a)
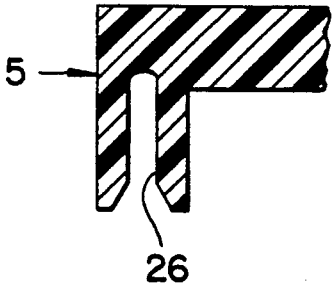
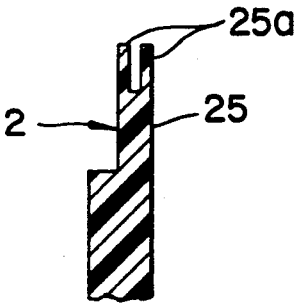
FIG. 13(b)

FIG. 19
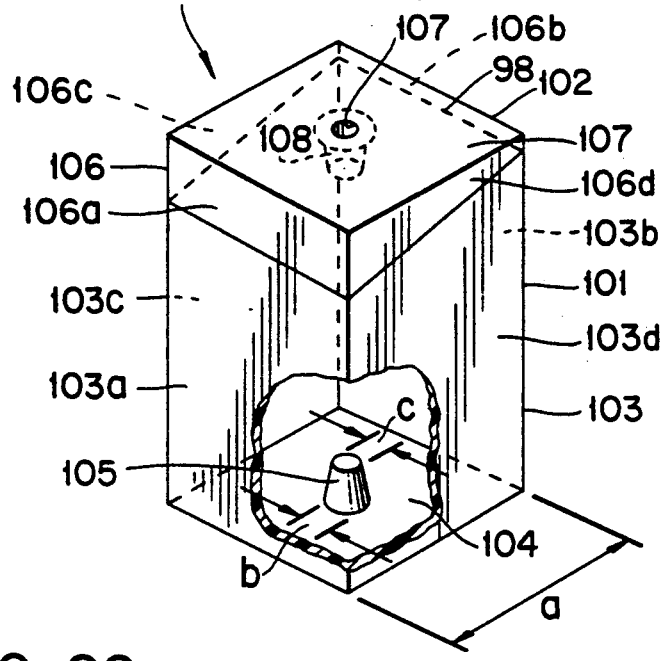
FIG. 20
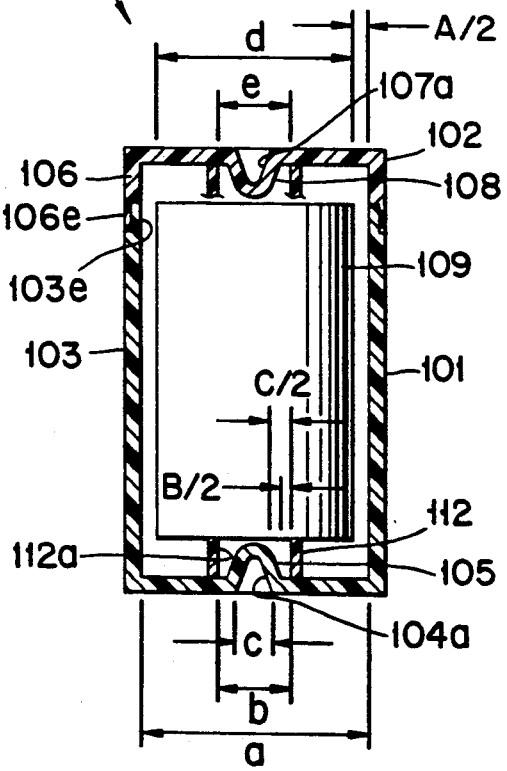
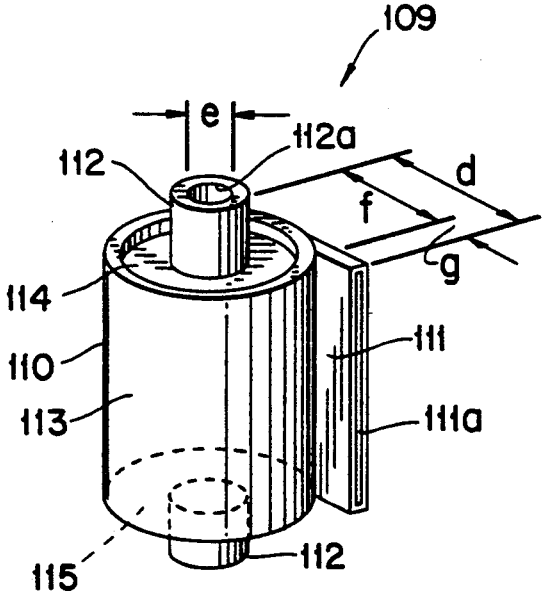
FIG. 21

CONTAINER FOR PHOTOGRAPHIC FILM CARTRIDGE

BACKGROUND OF THE INVENTION

This invention relates to a container for a photographic film cartridge.

Conventional containers for a photographic film cartridge are, as shown in Japanese Patent KOKAI No. 62-57256, composed of a container body for placing the photographic film cartridge and a cap for sealing the container body which is separately provided. The container for a photographic film cartridge is put in a small paper box in order to ensure the virginity of the commercial goods and to provide decorations as commercial goods, and is displayed in a store in this state.

Since the conventional containers for a photographic film cartridge were composed of two members, i.e. the container body and the cap, when the photographic film cartridge was taken out with one hand and in one motion, the cap was occasionally flipped away and lost. The container body and the cap were separately prepared resulting in an increase in manufacturing equipment. Moreover, when the photographic film cartridge was taken out, two operations were necessary, i.e. first, the small paper box was opened to take out the container for a photographic film cartridge, and then, the cap was detached. Therefore, there was a problem in ease of use. Besides, the photographic film cartridge was occasionally affected adversely by the external force, heat and the like added to the container containing the photographic film cartridge during secondary processing, such as printing, labelling and shrink packaging. The adverse effects included damage by the external force and the degradation of the primary functions, e.g. the function to stabilize photographically and the function to stabilize the motion of the film by the heat transmitted through the container. Furthermore, the photographic film cartridge was shaken by the external force to abrade the inner wall of the container, and the photographic film was occasionally affected adversely by the powder of the container formed by the abrasion and adhered to the photographic film cartridge.

SUMMARY OF THE INVENTION

An object of the invention is to provide a container for a photographic film cartridge composed of one member capable of being opened by one hand and one touch.

Another object of the invention is to provide a container for a photographic film cartridge capable of protecting the photographic film cartridge from the external force, heat and the like during secondary processing.

The inventor investigated in order to achieve the above objects and developed a novel container for a photographic film cartridge. First, the cap was connected to the container body, and the container body and cap constructed so that the container could be sealed and released by revolving the cap. The container was opened from the opposite side to the connecting portion that is used as the rotation axis. However, since the cap portion was necessary to be fitted tightly into the container body portion for ensuring sealing, a very strong force was necessary to detach the cap portion.

Thereupon, the inventor further investigated in order to develop an easily openable structure, and found that, when the container body portion was formed to have a certain degree of flexiblity, the fitted cap portion could gradually be detached by deforming the container body.

Thus, the container for a photographic film cartridge of the invention comprises a container body portion being flexible and polygonal and a cap portion fittable to the container body portion revolvably and integrally connected therewith, and the fitting between the container body portion and the cap portion being releasable by deforming the container body portion.

BRIEF DESCRIPTION OF THE DRAWINGS

FIG. 3 is a perspective view indicating a closed state of the above container, and FIG. 4 is a plan view, FIG. 5 is a front view, and FIG. 6 is a left side view thereof respectively.

FIG. 7 is an enlarged partial section of the connecting portion of the container.

FIG. 8 is an enlarged partial section of the fitting portion of the container, and (a) indicates a part of the cap side and (b) indicates a part of the container body side.

FIGS. 9 and 10 are perspective views of other containers for a photographic film cartridge embodying the invention.

FIG. 11 to 13 are partial sections indicating other examples of the fitting portion, and (a) indicates a part of the cap side and (b) indicates a part of the container body side.

FIG. 19 is a perspective view partially cutaway indicating another container for a photographic film cartridge embodying the invention, and FIG. 20 is a sectional view thereof showing the presence of a contained photographic film cartridge.

FIG. 21 is a perspective view of a photographic film cartridge.

DETAILED DESCRIPTION OF THE INVENTION

Figure 1:
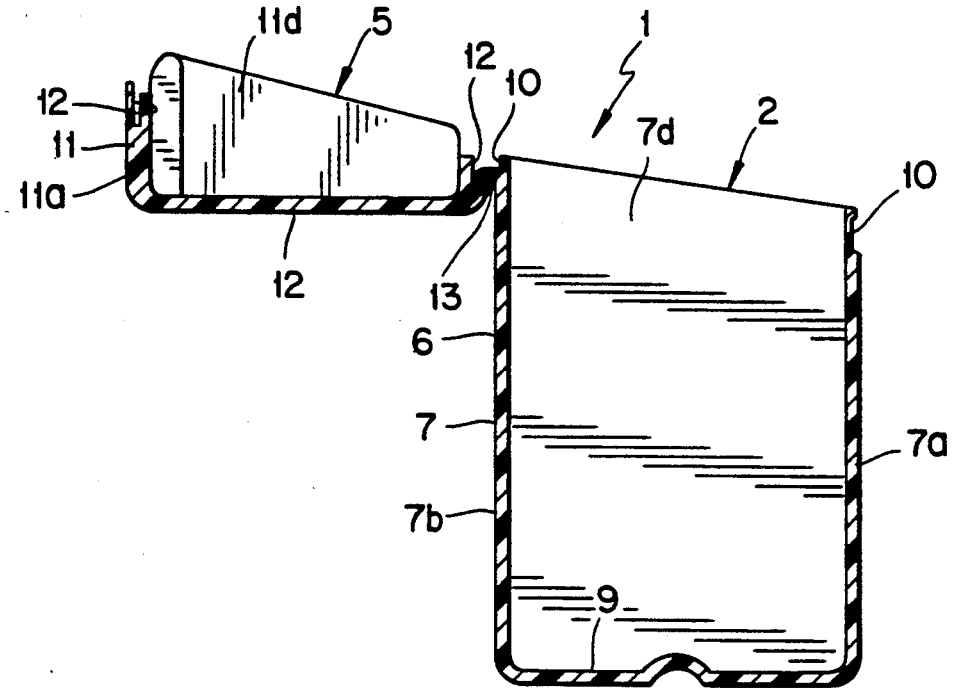
FIG. 1 is a sectional view indicating an opened state of a container for a photographic film cartridge embodying the invention.

The container body portion may be any polygonal form, such as square cylinder, hexagonal cylinder or octagonal cylinder, and square cylinder is the most preferable in view of the great deformation by pinching the edge portions of the container body portion and stacking and alignment of the container. The container body portion is necessary to be flexible. The flexibility means that the container body portion fitted with the cap portion can be deformed by one hand. As the compression force necessary for detaching the cap portion, not more than 10 kg, particularly not more than 6 kg, is preferred.

The cap portion is revolvably connected with the container body portion, and it may be stiff to a certain degree. The cap portion may be formed from a different material compared to the container body portion.

The container body portion and the cap portion are preferably formed by monolithic molding using polyethylene, polypropylene, ethylene-propylene copolymer or a blend thereof. The rigidity can be adjusted with reference to the bending elastic modulus among various properties of molding materials. Particularly, in the case of blended materials, the rigidity can be adjusted easily by changing the blending rate with reference to the bending elastic modulus of the raw materials to be blended ("Purasuchikku Zairyo Sentaku no Pointo (Point of Selecting Plastic Materials)", Japanese Standards Association. The adjustment of the rigidity is conducted by considering the openability by the deformation of the container body by pressing and the protection of the commercial goods contained therein, i.e. the photographic film and the cartridge, through physical distribution, display, and carrying and treating by the user. Recently, plastic containers have become a problem in view of environmental pollution, and the necessity of recycling and utilization of decomposable plastics have been recognized. In the container of the invention, since the container body portion and the cap portion are molded from the same material, the regeneration is easy. Since there is a possibility that the container is treated by earth filling as a waste, decomposable plastics are also preferred. Biodegradable polymers were already sold ("BIOPOL", ICI, "POLYCAPROLACTONE", UCC, etc.). Plastics can be degraded indirectly by blending a natural or synthetic polymer which is easily biodegradable, or starch-blended polyethylene is also usable. Photodegradable polymers can also be utilized. A known photodegradable polymer is ECO copolymer which is a copolymer of ethylene and carbon monoxide produced by introducing carbonyl groups into the main chain as phtosensitizing groups during the polymerization of ethylene. Photodegradability can be imparted by blending a transition metal salt, an oxidation accelerator, a photosensitizer or the like to the base polymer as an additive.

The fitting between the container body portion and the cap portion may be in any form capable of maintaining a joint, and the form of the projection and the channel and the forming side of them may be changed. In any event, the projection and the channel are preferably provided circumferentially, i.e. surrounding the edge portions, in order to ensure sealability.

By covering the container using a wrapping film, the virginity of the commercial goods can be guaranteed as well as decorations can be used. As the wrapping film, shrinkable films are preferred, such as made of polyvinyl chloride, polyester, polypropylene and polyethylene. When recycling is considered, the material of the wrapping film is preferably similar to the container for the regeneration. It is preferred to provide a cutting means for facilitating the opening of the container. The cutting means includes a perforation line and an easily peelable separation band, that is provided along the fitting part between the container body portion and the cap portion. A preferable cutting means is a perforation line, and is provided at least around a pair of diagonal edge portions, i.e. other than adjacent edge portions. The perforation line may be provided partially or circumferentially, and may be provided as a single line, double line or more.

A pair of projections are preferably formed around the center of the top portion of the cap portion and the bottom portion of the container body portion on the inside for supporting the cartridge for a photographic film. The projections are inserted into the end holes of the spool shaft with play, and inhibit the cartridge from contacting the inner wall of the container. Thus, the cartridge is protected from the external force, heat and the like added thereto during secondary processing, such as printing, labelling and shrink packaging, and from the generation of white powder caused by abrasion. In the case of the container of the invention, since the rigidity of the container body portion is lowered, to provide the projections is particularly effective.

When the projections are provided, it is necessary to satisfy $A > B$, wherein;

A = the inside size of the container body—the outside size of the cartridge

B = the inside size of the spool shaft—the outside size of the projection

The inside size of the container body is the minimum length in the cross direction of the inside of the container body portion. For example, in the case that the form of the container body portion is a circular cylinder, it is the inside diameter thereof. In the case that the form of the container body portion is a square cylinder, it is the length of a side.

The outside size of the cartridge is the maximum length in the cross direction of the outside of the cartridge. For example, in the case that the form of the cartridge is a circular cylinder, it is the outside diameter.

The inside size of the spool shaft is the maximum length in the cross direction of the inside of the spool shaft. For example, in the case that the form of the spool shaft is a circular cylinder, it is the inside diameter.

The outside size of the projection is the maximum outside diameter in the cross direction of the projection. For example, in the case that the form of the projection is a circular column, it is the diameter. In the case that the form of the projection is a cone, it is the diameter of the bottom.

The projection may be in various forms satisfying the above relation, such as circular columns and polygonal columns. In order to facilitate the insertion of the end hole of the spool shaft, the projection is made gradually small toward the top.

In order to ensure the insertion of the spool shaft completely, it is preferable to satisfy $A < C$, wherein;

C = the inside size of the spool shaft—the minimum outside size of the projection The minimum outside size of the projection is the minimum length in the cross direction of the outside of the projection. For example, in the case that the form of the projection is a cone, it is the outside diameter of the top. The reverse side of the projections is preferably indented. The indentation can be utilized for positioning and holding the container through providing secondary processings, such as printing, labelling and shrink packaging, and improves the secondary processing ability sharply.

In the container for a photographic film cartridge of the invention, the moistureproofness is ensured by fitting the cap portion to the container body portion.

When the cartridge is taken out of the container, the cap portion is gradually detached from the container body portion according to the deformation caused by pinching and pressing it. Since the cap portion is connected to the container body portion, the cap portion is still joined to the container body portion, after the fitting is released. Therefore, the container can be opened easily with one hand, and the cap portion is not lost. Though the container contains the cartridge, since the movement of the cartridge is limited by the projections, the cartridge can be inhibited from contacting the inner wall of the container. As a result, when an external force, heat or the like is added to the container during secondary processings thereof, the influences upon the cartridge can be minimized. Besides, the cartridge can be protected by a sufficient buffering action from the shaking and dropping movement during physical distribution.

The effects due to the projections are also effective for other containers of which the cap is separately provided. Such a container may be made of a more rigid material such as polystyrene.

EXAMPLES

An example of the container for a photographic film cartridge of the invention is illustrated in FIGS. 1 to 8.

The container 1 is, as shown in FIG. 3, formed in a rectangular parallelopiped composed of the container body portion 2 and the cap portion 5 for sealing the container body portion 2. The outer surface of the container 2 is entirely wrapped by a wrapping film 6.

The container body portion 2 is composed of a peripheral wall portion 7 and a bottom portion 9 which are integrally formed. As shown in FIG. 4, the peripheral wall portion 7 is composed of a front side 7*a*, a rear side 7*b*, a left side 7*c*, and a right side 7*d* and four edge portions 8*a*, 8*b*, 8*c*, 8*d*. The height of the rear side 7*b* is greater than the front side 7*a*, as shown in FIG. 6, and therefore, the upper edges of the left side 7*c* and the right side 7*d* are inclined downward from the rear side to the front side.

The cap portion 5 is composed of a cap peripheral wall portion 11 and a top portion 12 which are integrally formed. As shown in FIG. 4, the cap peripheral wall portion 11 is composed of a cap front side 11*a*, a cap rear side 11*b*, a cap left side 11*c* and a cap right side 11*d*. The height of the cap front side 11*a* is greater than the cap rear side 11*b*, and the total height of the cap portion 5 and the container body portion 2 on the four sides are substantially identical, when the cap portion 5 is fitted to the container body portion 2.

Figure 2:
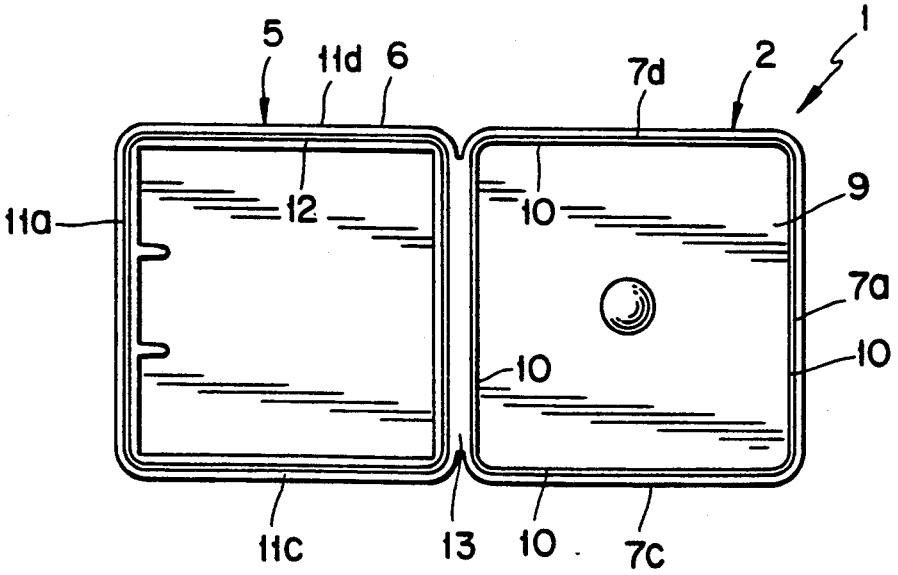
FIG. 2 is a plan view thereof.

As shown in FIGS. 1 and 2, the lower end of the cap rear side 11*b* is connected to the upper end of the rear side 7*b* of the container body 2 through the connecting portion 13 integrally. The connecting portion 13 is flexible and elastic, and the cap portion 5 is opened in an unloaded state. Therefore, the cap portion 5 is rotatable around the upper end of the rear side 7*b*, and always urged toward the opening direction. A circumferential fitting projection 10 is formed upward on the upper edge of the peripheral wall portion 7, and a circumferential hook portion 10*a* is formed on the fitting projection 10. While, a circumferential fitting channel 12 is formed upward on the lower edge of the cap peripheral wall portion 11, and an engaging portion 12*a* is formed at the bottom of the fitting channel 12. When the cap portion 5 is fitted to the container body portion 2, the fitting projection 10 is fitted into the fitting channel 12, and the container body portion 2 is sealed by the cap portion 5. As shown in FIG. 7, the hook portion 10*a* and the engaging portion 12*a* are made narrow on the rear side (connecting portion), and are made broad on the other three sides.

The wrapping film 6 wrapping the container 1 is a shrinkable film, and printing such as a trade name is provided on the surface. As shown in FIG. 3, a perforation line 14 is provided as a cutting means circumferentially along the fitting part between the container body portion 2 and the cap portion 5.

When the photographic film cartridge is taken out of the container 1, an edge portion 8*c* or 8*d* of the rear side 7*b* and the diagonal edge portion 8*a* or a 8*b* are pinched and pressed by fingers. Then, the container body 2 is deformed into a rhombus, and the cap portion 5 is gradually detached from the corners of the rhombus. At that time, the wrapping film 6 is stretched according to the movement of the cap portion 5, and torn into two pieces along the perforation line 14. Thus, the cap portion 5 is entirely opened by the elasticity of the connecting portion 13.

Two other examples of the container for a photographic film cartridge of the invention are illustrated in FIGS. 9 and 10. The container for a photographic film cartridge of FIG. 9 is formed in a hexagonal column, and that of FIG. 10 is an octagonal column. In these containers, the pinching part by fingers may be any pair of diagonal edges or side faces except adjacent pairs.

Three other examples of the fitting structure are shown in FIGS. 11 to 13. In the fitting structure of FIG. 11, the upper end of the fitting projection 20 is inflated round, and the inflated round portion is the circumferential hook portion 20*a*. The bottom of the fitting channel 21 is also inflated round into the corresponding form to the hook portion 20*a*, and the inflated round portion is the engaging portion 21*a*. In the fitting structure of FIG. 12, the upper end of the fitting projection 22 is made thin to form a step. The fitting channel 23 is formed in the same width, and the bottom is formed in a circular arc. When the fitting projection 22 is fitted into the fitting channel 23, the thinned portion 22*a* is deformed elastically in the fitting channel 23, and the fitting projection 22 is fixed to the fitting channel 23 by the reaction. In the fitting structure of FIG. 13, a deep groove is formed at the top of the fitting projection 25, and the fitting channel 26 has a similar form to FIG. 12. When the fitting projection 25 is fitted into the fitting channel 26, the fitting projection 25 is fixed to the fitting channel 26 by the elastic deformation of both thinned portions 25*a* formed by the deep groove, similar to FIG. 12. In all of the above fitting structures, both edges of the fitting channels 21, 23, 26 are cut obliquely so as to facilitate the insertion of the fitting projections 20, 22, 25.

Figure 14:
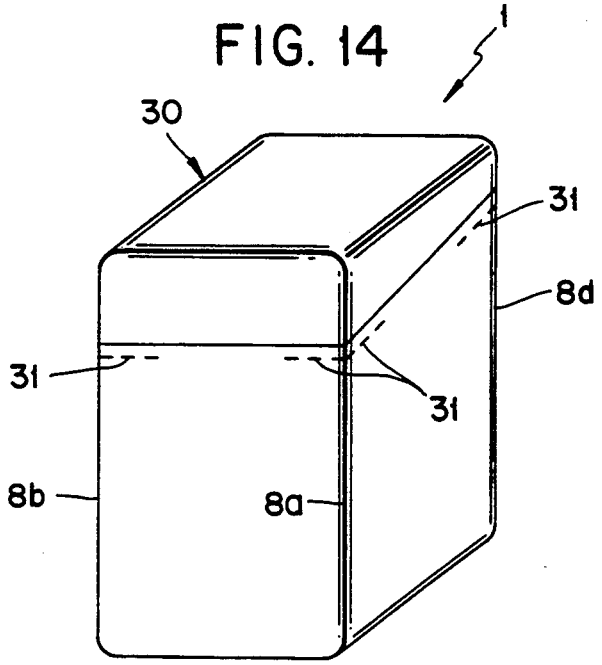
FIGS. 14 to 16 are perspective views of similar containers to the container of FIGS. 1 to 8 wherein the cutting line provided on the wrapping film is changed.
Figure 15:
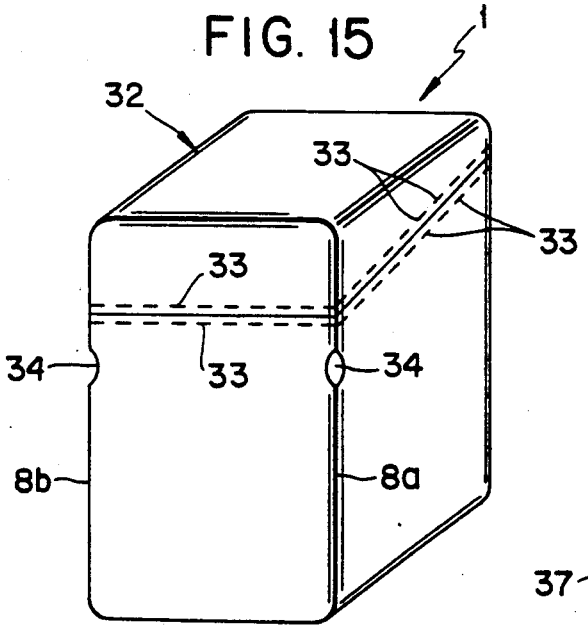
Figure 16:
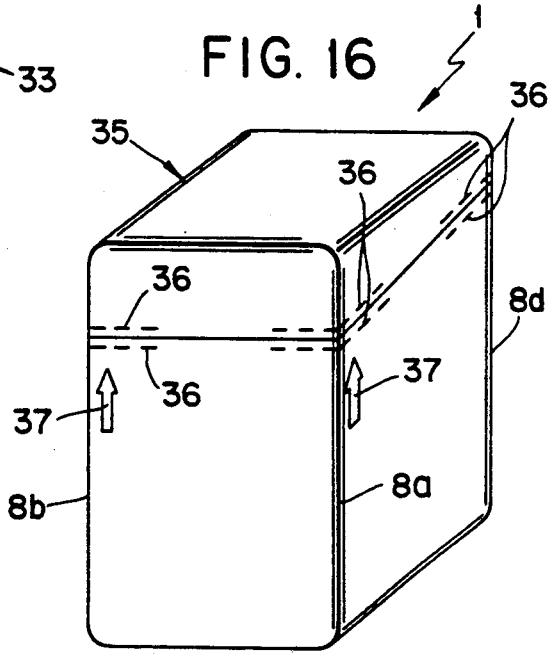

Three other examples of the cutting lines provided on the wrapping film are shown in FIGS. 14 to 16. In the wrapping film 30 of FIG. 14, the perforation lines 31 are provided only around the edge portions 8*a*, 8*b*, 8*c*, 8*d*. In the wrapping film 32 of FIG. 15, two perforation lines 33, 33 are provided circumferentially in parallel above and below the fitting part between the container body portion 2 and the cap portion 5. When a deviation occurs in the position of the perforation lines 33, 33 during manufacturing the wrapping film, the wrapping film 32 can be cut along either of the perforation lines 33, 33. In this example, recess portions 34, 34 are provided at both edge portions 8*a*, 8*b* of the front side for indicating a suitable pinching part and for facilitating pinching. In the wrapping film 35 of FIG. 16, the perforation lines 36 are provided double only around the edge portions 8a, 8b, 8c, 8d, and arrows 37, 37 are provided on the wrapping film 35 near the edge portions 8a, 8b for indicating the pressing part.

Figure 17:
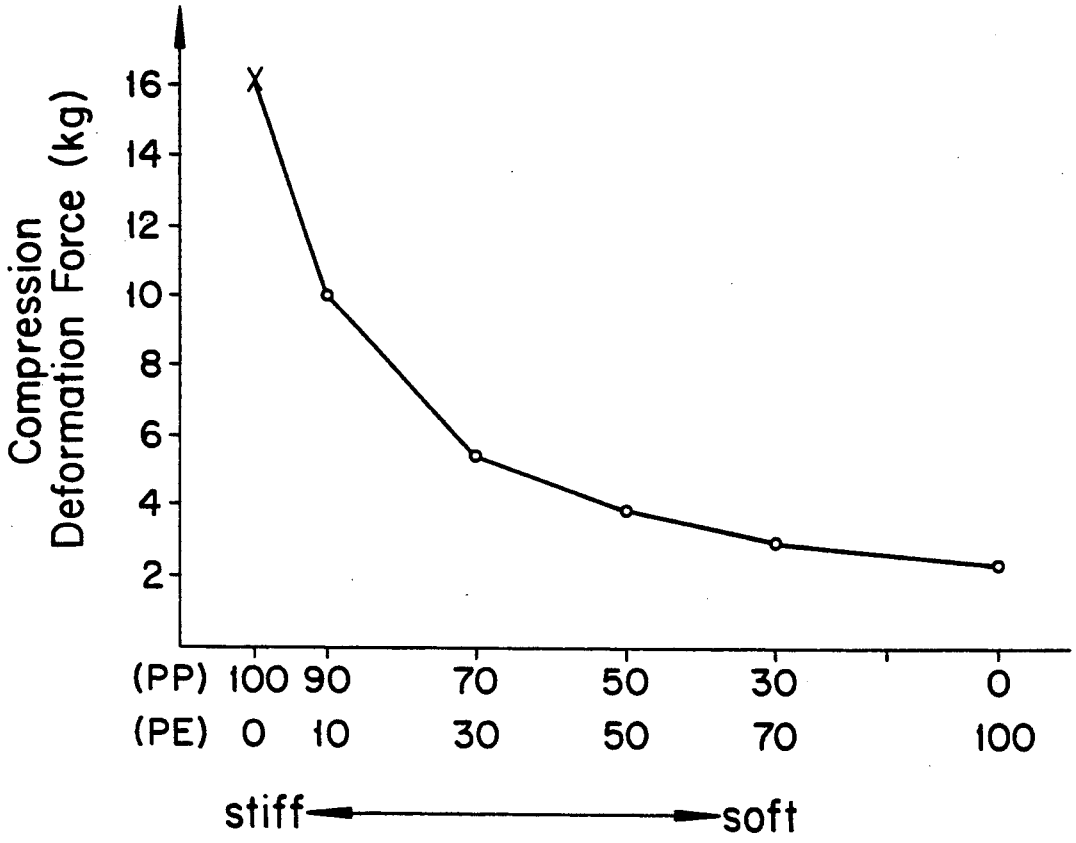
FIG. 17 is a graph indicating a relation between the mixing rate of a polypropylene resin to a polyethylene resin and compression deformation force, and FIG. 18 indicates a compression measuring device.
Figure 18:
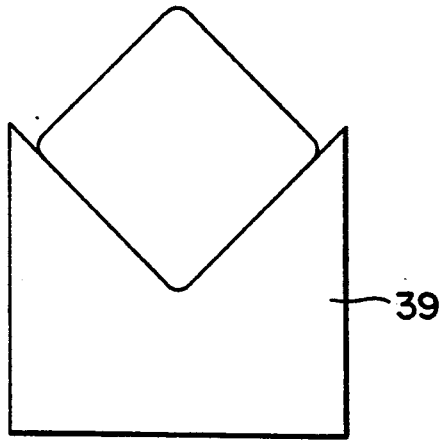

A deformation test of the containers for a photographic film container was conducted. The containers tested had a form of FIGS. 1 to 8, and were prepared by monolithic molding using a mixture of polypropylene (PP) and polyethylene (PE). The wall thickness was 1.1 mm, and the mixing rate of PP/PE was varied from 0 to 100. The fitting strength between the container body portion and the cap portion was adjusted so that the moisture in the container became less than 10 mg/24 hrs. Each container was put on a V-shaped table 39 of a compression tester ("STROGRAPH" TOYO SEIKI CO., LTD. shown in FIG. 18 so that the connecting portion 13 was contacted with the V-shaped table 39. Then, the container was pressed downward, and the force necessary for releasing the fitting between the container body portion and the cap portion was measured as the compression deformation force (opening force). The results are shown in FIG. 17 wherein 0 indicates that the container could be opened by one hand and X indicates that the container could not be opened by one hand. Thus, it was found that when the compression deformation force was 16 kg, the container could not be opened by one hand. Whereas, when the compression deformation force was not more than 10 kg, the container was easily deformed to be opened by one hand. In order to render the compression deformation force not more than 10 kg, the mixing rate of PP/PE was set in the range of 90/10 to 0/100.

The container was wrapped by polyvinyl chloride shrinkable film 40μ thick provided with the perforation lines shown in FIG. 3, 14, 15 or 16 or not, and the compression deformation force (opening force) was measured. As a result, the compression deformation force in each case was similar to that of the container not wrapped.

Another example of the container for a photographic film cartridge of the invention is illustrated in FIGS. 19 to 23.

The container 100 is, as shown in FIG. 19, formed in a rectangular parallelopiped composed of the container body portion 101 and the cap portion 102 for sealing the container body portion 101.

The container body portion 101 is composed of a peripheral wall portion 103 and a bottom portion 104 which are integrally formed. The peripheral wall portion 103 is, composed of a front side 103a, a rear side 102b, a left side 103c, and a right side 103d. The height of the rear side 103b is greater than the front side 103a, as shown in FIG. 19, and therefore, the upper edges of the left side 103c and the right side 103d are inclined downward from the rear end to the front end. A projection 105 is formed at the center of the inside of the bottom portion 104. The total form of the projection 105 is almost a truncated cone of which the base diameter (b) is greater than the top diameter (c), and as shown in FIG. 20, it can be inserted with play into the end hole 112a of the spool shaft 112 of the photographic film cartridge 109 shown in FIG. 21. On the reverse side of the projection 105, i.e. at the center of the outside of the bottom portion 104, an indentation 104a. The indentation 104a can be utilized for positioning and holding the container together with the providing secondary processings, such as printing, labelling and shrink packaging, and improves the secondary processing ability of the container 100 for a photographic film cartridge.

The cap portion 102 is composed of a cap peripheral wall portion 106 and a top portion 107 which are integrally formed. The cap peripheral wall portion 106 is composed of a cap front side 106a, a cap rear side 106b, a cap left side 106c and a cap right side 106d. The height of the cap front side 106a is greater than the cap rear side 106b, and the total height of the cap portion 102 and the container body portion 101 on the four sides are substantially identical, when the cap portion 102 is fitted to the container body portion 101. A projection 108 is formed at the center of the inside of the top portion 107. The form of the projection 108 is substantially the same as the projection 105 of the bottom portion 104, and an indentation 107a having substantially the same form as the indentation 104a of the bottom portion 104 is formed on the reverse side of the projection 108, i.e. at the center of the outside of the top portion 107.

The lower end of the cap rear side 106b is connected to the upper end of the rear side 103b of the container body 101 through the connecting portion 98 integrally. The connecting portion 98 is flexible and elastic, and the cap portion 102 is opened in an unloaded state. Therefore, the cap portion 102 is rotatable around the upper end of the rear side 103b, and always urged toward the opening direction. As shown in FIG. 20, a circumferential fitting projection 103e is formed upward on the upper edge of the peripheral wall portion 103, and a circumferential fitting channel 106e is formed upward on the lower edge of the cap peripheral wall portion 106. The cap portion 102 seals the container body portion 101 by fitting the fitting projection 103e to the fitting channel 106e.

A photographic film cartridge 109 placed in the container 100 for a photographic film cartridge is shown in FIG. 21. The cartridge 109 has a cartridge body 110, an exit port portion 111 and a spool shaft 112. The container body 110 has a body portion 113 formed in a cylindrical shape, a top 114 and a bottom 115 joined to both ends of the body portion 113. The exit port portion 111 is formed integrally with the body portion 113 of the cartridge body 110 in a form of a rectangular plate, and is provided with a slit 111a for extending a photographic roll film (not illustrated). The spool shaft 112 supports the photographic roll film by winding it around the shaft 112, and is formed in a cylindrical shape. End holes 112a, 112a are formed on both ends of the shaft 112. The shaft 112 penetrates the top 114 and the bottom 115 of the cartridge body 110, and is rotatably supported by the cartridge body 110.

The dimensional correlation of respective portions between the container 100 for a photographic film cartridge and the photographic film cartridge 109 placed therein shown in FIGS. 19 to 21 is, $$B<A<C,$$

wherein,

A=(Inside Size a of Container Body 101)−(Outside Size d of Cartridge)

d=(Outside Diameter f of Cartridge Body 110)+(width g of Exit Port Portion 111)

B=(Inside Size e of Spool Shaft 112)−(Outside Size b of Projection 105, 108)

C=(Inside Size e of Spool Shaft 112)−(Minimum Outside Size c of Projection 105, 108)

The cap portion 102 of the container 100 for a photographic film cartridge is opened, and the photographic film cartridge 109 is put therein. The cap portion 102 is revolved around the connecting portion 98 as the supporting point, and the fitting channel 106*e* formed on the lower edge of the cap peripheral wall portion 106 is fitted to the fitting projection 103*e* formed on the upper edge of the peripheral wall portion 103 to seal the container body portion 101 by the cap portion 102. In this state, as shown in FIG. 20, the projections 105, 107 of the container body portion 101 and the cap portion 102 are inserted with play into the end holes 112*a*, 112*a* of the spool shaft 112, and the motion of the photographic film cartridge 109 is limited in a prescribed range. That is, when the photographic film cartridge 109 is put in the container 100, the insertion of the projections 1 05, 107 is facilitated and ensured by the relation of A<C. Then, the motion of the spool shaft 112 of the photographic film cartridge 109 is limited to the range of B in FIG. 20. If the spool shaft 112 of the photographic film cartridge moves in the range of B, there is a space of A between the body portion 113 of the cartridge 109 and the peripheral wall portion 101 of the container 100. Thus, the cartridge 109 does not contact the peripheral wall portion 101 of the container 100.

Figure 22:
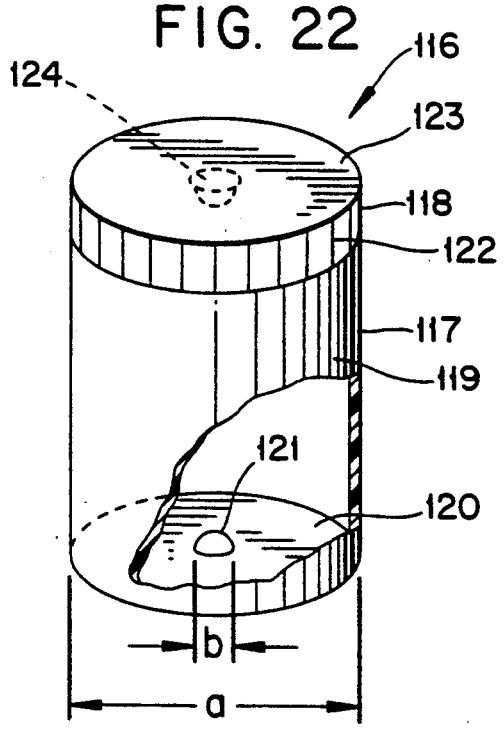
FIG. 22 is a perspective view partially cutaway of another container for a photographic film cartridge embodying the invention.

Another example of the container 116 for a photographic film cartridge of the invention is illustrated in FIG. 22. The container 116 is formed cylindrical, and is composed of a cylindrical container body 117 and a cap 118 for sealing the container body 117.

The container body 117 is integrally formed of a cylindrical peripheral wall portion 119 and a bottom portion 120. A semispherical projection !21 is formed at the center of the inside of the bottom portion 120, and the diameter of the base of the projection 121 is the same as the diameter of the sphere forming the projection !21. The projection 121 can be inserted with play into the end hole 112*a* of the spool shaft 112 of the photographic film cartridge 109 shown in FIG. 21.

The cap 118 is integrally formed of a cylindrical cap peripheral wall portion 122 and a top portion 123 provided with a projection !24 at the center having substantially the same form as the projection 121 of the bottom portion 120 of the container body 117.

The outside diameter of the cap 118 is almost the same as the inside diameter of the container body 117, and the material forming the cap 118 is more flexible than the container body 117. Therefore, the cap 118 can be deformed and fitted into the container body 117 by pressing.

The dimensional correlation of respective portions between the container 116 for a photographic film cartridge and the photographic film cartridge 109 placed therein is the same as the case of the container 100 shown in FIGS. 19 and 20.

The photographic film cartridge 109 shown in FIG. 21 was put in the container 116 for a photographic film cartridge shown in FIG. 22. The size of them is as follows:

| Container for a Photographic Film Cartridge | | |
|---|---|---|
| Inside Diameter of Container Body | a: | 30.4 mm |
| Maximum Diameter of Projection | b: | 8.0 mm |
| Photographic Film Cartridge | | |
| Maximum Width of Cartridge | d: | 28 mm |
| Outside Diameter of Cartridge Body | f: | 25 mm |
| Width of Exit Port Portion | g: | 3 mm |
| Inside Diameter of Spool Shaft | e: | 9.4 mm |

The dimensional correlation is, $$A=30.4-28=2.4$$

$$B=9.4-8.0=1.4$$

i.e., $A>B$

As the secondary processings, a label was adhered onto the surface of the container 106, and the container 106 was then wrapped by a shrinkable film. As a result, the photographic film was not damaged by the external force and heat, and white powder was not generated.

Figure 23A:
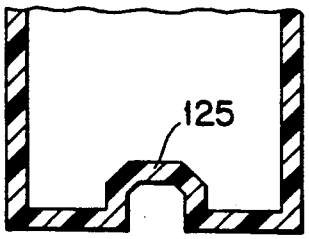
FIGS. 23(*a*)–(*c*) are partial sections indicating other examples of the projection.
Figure 23B:
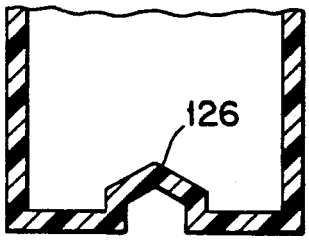
Figure 23C:
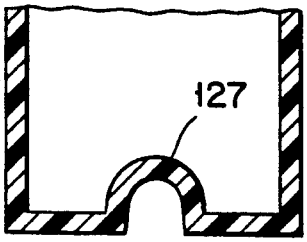

Three other example of the projection provided at the center of the bottom portion of the container body are illustrated in FIG. 23 (*a*)–(*c*). The projection 125 shown in FIG. 23 (*a*) is composed of a lower half part of a circular cylinder portion an upper half part of a truncated cone portion. The projection 126 shown in FIG. 23 (*b*) is composed of a lower half part of a circular cylinder portion and the upper half part of a cone portion. The projection 127 shown in FIG. 23 (*c*) is composed of a lower half part of a circular cylinder portion and the upper half part of a semispherical portion. In all of an above projections 125, 126, 127, an indentation having a similar figure is formed coaxially on the opposite side.

The container for a photographic film cartridge of the invention can be applied for various photographic film cartridges, including various commercial 35 mm photographic film cartridges and those shown in FIGS. 24 to 31.

Figure 24:
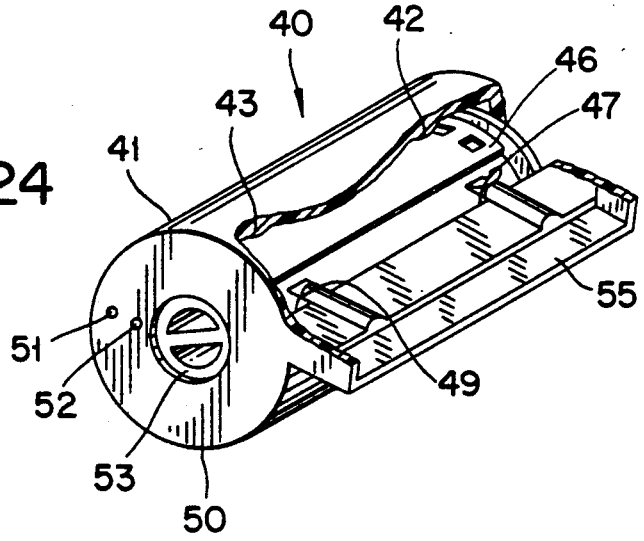
FIGS. 24 to 31 indicate various photographic film cartridges applicable to the container of the invention.

In the photographic film cartridge 40 shown in FIG. 24, a pair of ribs 42, 43 are formed integrally on the inner wall of the cartridge body 41 along the circumferential direction. The ribs 42, 43 catch the film 46 on the periphery and inhibit the film 46 from loosening. Each rib 42, 43 is provided with a separating claw 47, 49 which catches an separates the leading end of the film 46 from the periphery of the film 46. A pair of terminals 51, 52 is provided on the cartridge cap 50. In the photographic film cartridge 40, when the spool 53 is revolved in the clockwise direction, the leading end of the film 46 is revolved in the same direction to be caught by the separating claws 47, 49. Then, the leading end of the film 46 is separated from the periphery of the film 46 by the separating claws 47, 49, and fed to the outside of the cartridge 40 through the slit 55.

Figure 25:
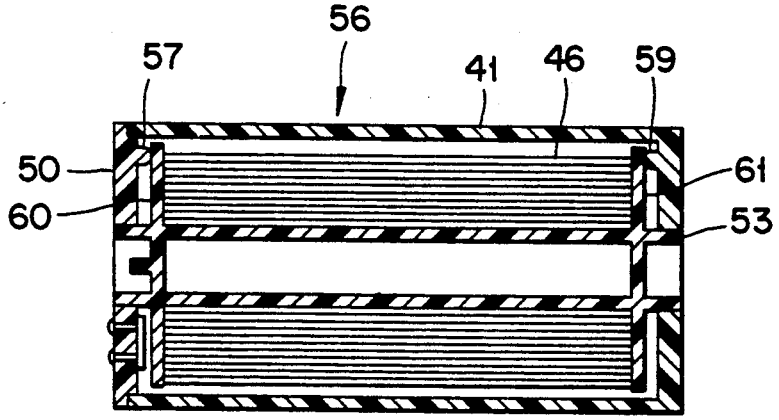

In the photographic film cartridge 56 shown in FIG. 25, a pair of projections 57, 59 are formed on the inner walls of the cartridge body 41 and the cartridge cap 50 so as to face each other. The projections 57, 59 catch the spool on the flanges 60, 61, and press to bend them toward the inside. The bent flanges 60, 61 nip both sides of the film 46 so as not to separate the leading end of the film 46 from the periphery. Therefore, the film 46 is not loosened, and the initial film advance can be conducted by revolving the spool 53.

Figure 26:
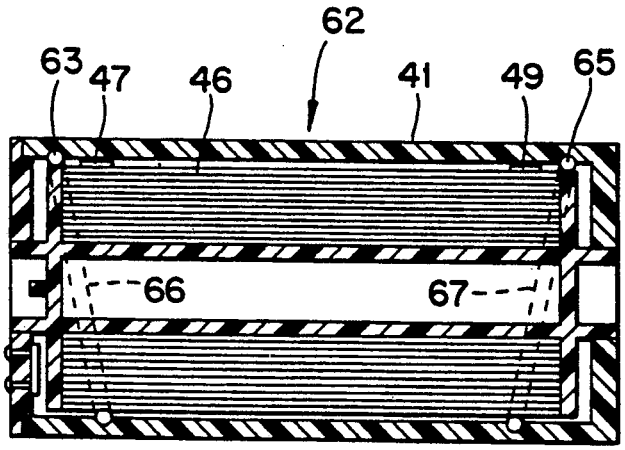

In the photographic film cartridge 62 shown in FIG. 26, a pair of grooves 63, 65 are formed on the inner wall of the cartridge body 41 along the circumferential direction, and rings 66, 67 catch the film 46 on the periphery to press it so as not to be loosened. When the leading end of the film 46 is revolved in the upper direction in FIG. 26 by revolving the spool 53, the leading end of the film 46 is released from the rings 66, 67. Then, the leading end is separated from the periphery by the separating claws 47, 49, and delivered to the slit.

Figure 27:
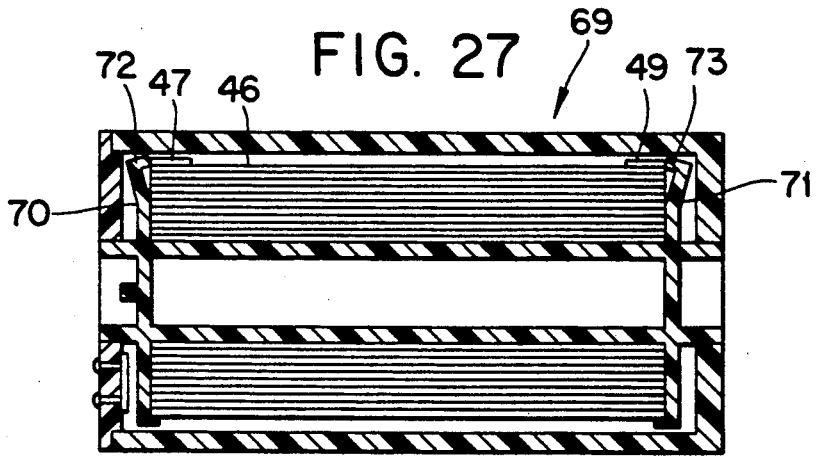

In the photographic film cartridge 69 shown in FIG. 27, claws 72, 73 projecting toward the inside are provided along the periphery of the flanges 70, 71. The claws 72, 73 catch the film 46 on the periphery, and inhibit the film 46 from loosening. The claws 72, 73 catch the separating claws 47, 49 on a side thereof, and are pressed so as to be bent toward the outside, as shown in FIG. 27. Therefore, when the leading end of the film 46 is revolved and caught on the separating claws 47, 49, the leading end is released from the inhibition by the claws 72, 73. Then, the leading end is separated from the periphery of the film 46, and delivered to the slit.

Figure 28:
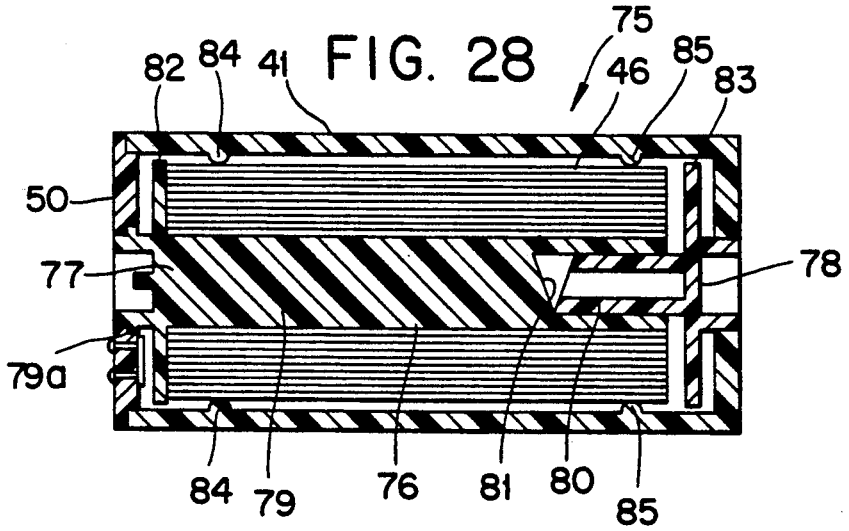
Figure 29:
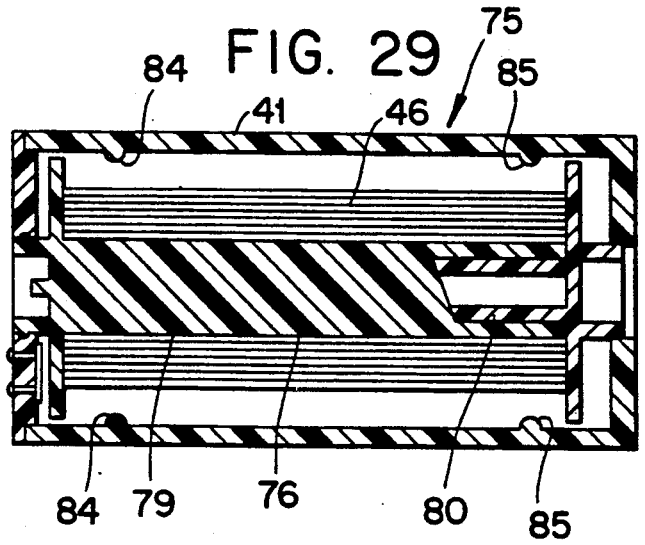

In the photographic film cartridge 75 shown in FIGS. 28 and 29, the spool 76 is composed of two spool pieces 77, 78, and the shaft 80 of one spool piece 78 is slidably inserted into the cylindrical shaft 79 of the other spool piece 77. A rib 79*a* is formed on the periphery of the shaft 79, and is fitted into a groove formed on the cartridge cap 50. The front end of the shaft 80 is caught on the uppermost edge of the oblique face 81 being the bottom of the hole for the insertion of the shaft 80, and the spool 76 is positioned in the expanded state as shown in FIG. 28. Each spool piece 77, 78 is provided with a flange 82, 83 which is slightly inclined toward the inside. Ribs 84, 85 are formed on the inner wall of the cartridge body 41 along the circumferential direction, and catch the film wound around the spool piece 77 on the periphery so as not to be loosened. Therefore, when the spool piece 77 is revolved, the leading end of the film 46 is delivered to the outside of the cartridge 75 similar to the cartridge 56 shown in FIG. 25. During the revolution of the spool piece 77, the other spool piece 78 slides in the left direction in the figure by a cam groove (not illustrated), and the front end of the shaft is completely contacted with the oblique face 81 of the shaft 79. As a result, the spool 76 is positioned in the contracted state as shown in FIG. 29, and the flanges 82, 83 nip both sides of the film 46. Therefore, after the film 46 is delivered to the outside of the cartridge 75, unless the ribs 84, 85 catch the periphery of the film 46, the film 46 is not loosened as shown in FIG. 29.

Figure 30:
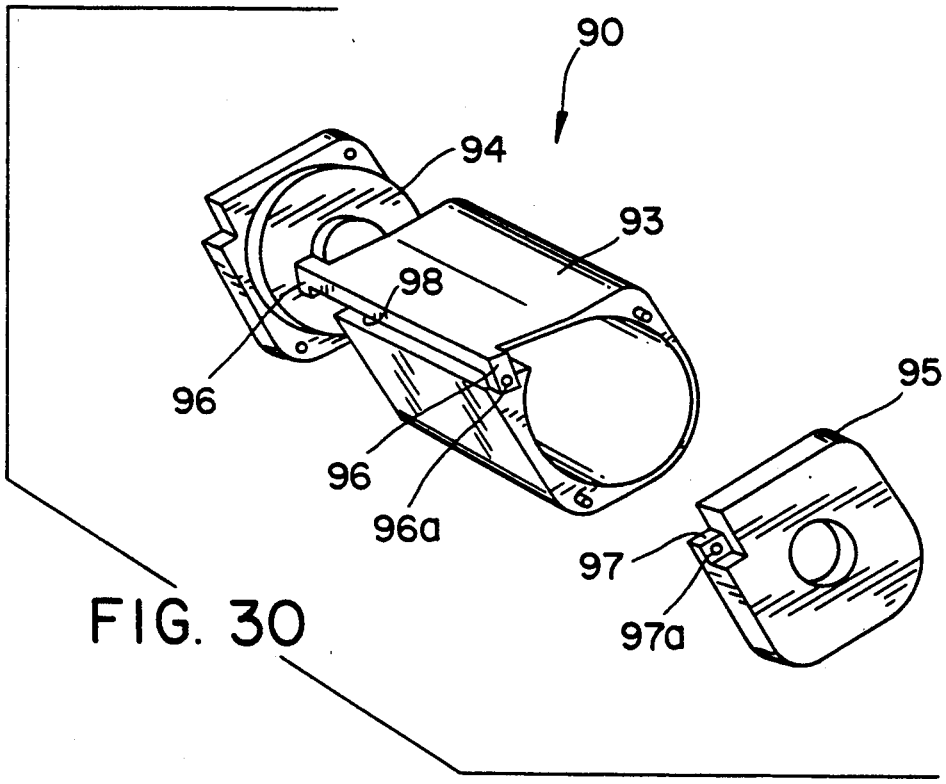
Figure 31:
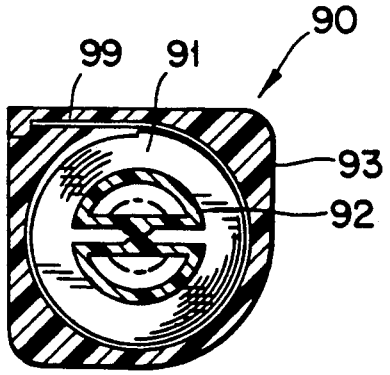

The photographic film cartridge 90 shown in FIGS. 30 and 31 is composed of a spool 92 on which a photographic film 91 is wound, a cartridge body 93 and two cartridge caps 94, 95 fitted to both ends of the cartridge body 93. The cartridge body 93 has a form of a square cylinder of which one edge is greatly rounded, and the edge counter to the rounded edge is cut off in the direction parallel to the axis. A bracket 96 is projected in a L-shape from both sides of one cut-off end 98, and a hole 96*a* is provided at the lower part. The cut-off ends 98 are urged toward the opening direction by the elasticity of the resin material itself forming the cartridge body 93. An engaging recess 97 is formed at the corner of each cartridge cap 94, 95 corresponding to the bracket 96, and a projection 97*a* is provided on the recess 97. In the state prior to use, the cartridge caps 94, 95 are fitted to both ends of the cartridge body 93, and the cut-off part 99 is closed by engaging the holes 96*a* of the brackets 96 with the projections 97*a* of the engaging recesses 97. Thus, the film 91 placed in the cartridge 90 is shielded from the light of the outside. When the cartridge 90 is loaded in a camera, one or both of the projections 97*a* are pushed by a camera member to release the engaging. Thus, the cut-off part 99 is opened by the elasticity of the resin to form an exit of the film 91. In this state, the film 91 is extended out of the cartridge 90, and successively exposed to the light to form an image. Then, the film 91 is rewound into the cartridge 90, and then the cartridge 90 is closed again by pushing the cut off part 98 by a camera member.

I claim:

1. A container for a photographic film cartridge consisting essentially of a flexible square container body portion having four sides and a cap portion fittable to the container body portion and revolvably and integrally connected thereto by a connecting portion on one side of the container body portion wherein fitting between the container body portion and the cap portion occurs along a fitting portion, said fitting portion extending in a downward direction from the side having the connecting portion to the side opposite the side having the connecting portion wherein said fitting portion is comprised of a fitting channel and a fitting projection which fits into said fitting channel when said cap portion is fitted to said container body portion, said fitting projection and said fitting channel being narrower on the side having the connecting portion, and wherein said container is wrapped by a wrapping film provided with cutting means along the fitting portion.

2. The container of claim 1 wherein said cutting means is a perforation line provided at least around a pair of diagonal edge portions.

3. The container of claim 2 wherein the perforation line is circumferentially provided.

4. The container of claim 2 wherein the perforation line is doubled.

5. The container of claim 1 wherein the fitting portion comprises a circumferential fitting projection formed on an edge of the container body portion or on an edge of the cap portion and a circumferential fitting channel formed on an opposing edge.

6. The container of claim 1 wherein said fitting between the container body portion and the cap portion can be released by pinching counter edge portions of the container body portion by a force of not more than 10 kg.

* * * * *